US007926741B2

(12) United States Patent
Laidler et al.

(10) Patent No.: US 7,926,741 B2
(45) Date of Patent: Apr. 19, 2011

(54) AEROSOL DISPENSER

(75) Inventors: Keith Laidler, Stourbridge (GB); Kevin Laidler, Worcester (GB)

(73) Assignee: Leafgreen Limited, Wollaston, Stourbridge West Midlands (GB)

( * ) Notice: Subject to any disclaimer, the term of this patent is extended or adjusted under 35 U.S.C. 154(b) by 429 days.

(21) Appl. No.: 11/885,622

(22) PCT Filed: Mar. 7, 2006

(86) PCT No.: PCT/GB2006/000794
§ 371 (c)(1),
(2), (4) Date: Apr. 28, 2008

(87) PCT Pub. No.: WO2006/095153
PCT Pub. Date: Sep. 14, 2006

(65) Prior Publication Data

US 2009/0020568 A1 Jan. 22, 2009

(30) Foreign Application Priority Data

| | | |
|---|---|---|
| Mar. 8, 2005 | (GB) | 0504708.9 |
| Apr. 5, 2005 | (GB) | 0506874.7 |
| Jun. 11, 2005 | (GB) | 0511915.1 |
| Nov. 18, 2005 | (GB) | 0523461.2 |

(51) Int. Cl.

| | |
|---|---|
| ***B05B 7/32*** | (2006.01) |
| ***B05B 7/12*** | (2006.01) |
| ***B05B 7/04*** | (2006.01) |
| ***B65D 83/14*** | (2006.01) |
| ***B65D 83/28*** | (2006.01) |
| ***B65D 83/44*** | (2006.01) |
| ***B65D 83/58*** | (2006.01) |

(52) U.S. Cl. ..... 239/337; 239/372; 239/407; 239/434; 222/402.1; 222/402.18

(58) Field of Classification Search ..... 239/302, 239/311, 337, 341, 366, 368, 369, 372, 398, 239/407, 410, 411, 413, 433, 434, 573; 222/394, 222/396, 402.1, 402.18, 402.23, 402.25
See application file for complete search history.

(56) References Cited

U.S. PATENT DOCUMENTS 3,790,089 A * 2/1974 Frangos ..... 239/573
4,230,243 A 10/1980 Spitzer et al.
(Continued)

FOREIGN PATENT DOCUMENTS

FR 2705323 11/1994
(Continued)

*Primary Examiner* — Darren W Gorman
(74) *Attorney, Agent, or Firm* — John H. Pearson, Jr.; Walter F. Dawson, Esq.; Pearson & Pearson, LLP

(57) ABSTRACT

An aerosol dispenser has a canister to contain a liquid product to be dispensed together with a propellant present at least partly as a gas and valve to control the release of the liquid product from the canister. The dispenser also has a vapor phase tap for introducing a portion of the gaseous propellant into the liquid product as it is dispensed. The dispenser has a flow control device for varying the rate at which the propellant has is introduced into the liquid product through the vapor phase tape in dependence on the pressure of the contents of the canister. The flow control device can be used to reduce the amount of propellant gas bled into the liquid product, particularly when the dispenser is full and the pressure in the canister is high, as a way of conserving the propellant gas.

27 Claims, 6 Drawing Sheets

U.S. PATENT DOCUMENTS

| | | | | | |
|---|---|---|---|---|---|
| 4,487,334 | A | | 12/1984 | Werding | |
| 4,754,897 | A | | 7/1988 | Brace | |
| 5,125,546 | A | * | 6/1992 | Dunne et al. | 222/394 |
| 5,211,317 | A | * | 5/1993 | Diamond et al. | 222/394 |
| 5,429,279 | A | | 7/1995 | Heijden | |

FOREIGN PATENT DOCUMENTS

| | | | |
|---|---|---|---|
| WO | WO 2004/022451 | A2 | 3/2004 |
| WO | WO 2005/005055 | A1 | 1/2005 |

* cited by examiner

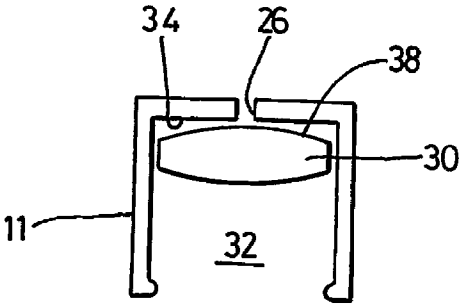
Fig. 10
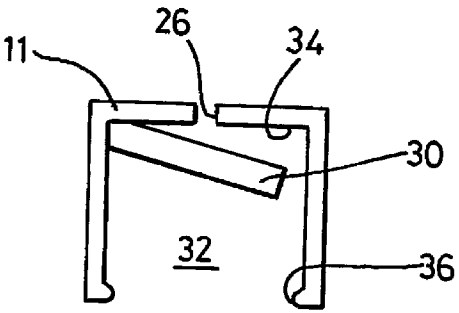
Fig. 11
Fig. 12
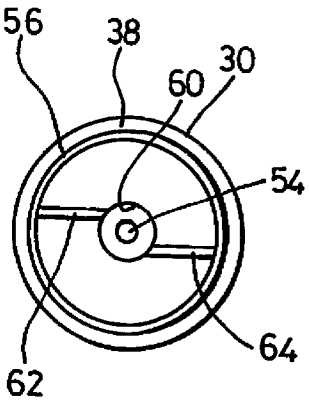
Fig. 13
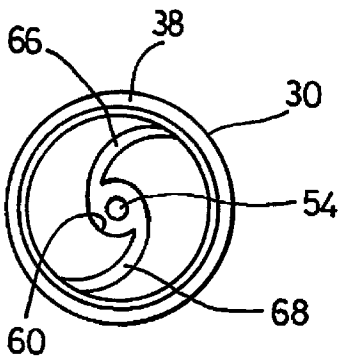
Fig. 14

AEROSOL DISPENSER

This invention relates to an aerosol dispenser.

It is known to provide an aerosol dispenser comprising a container or canister in which a product is stored under pressure. A valve is provided to enable the product to be dispensed from the container when the valve is opened. The product to be dispensed will often be a liquid, such as a liquor for example, and a propellant will also be present in the canister at least partly as a compressed gas. Some propellants, such as butane, are present partly as a gas and partly as a liquid, which may be in solution in the liquid product. Other propellants, such as compressed air or nitrogen, are present only as a gas whilst with propellants such as carbon dioxide a limited amount of the gas may be held in suspension in a liquid. In certain aerosol dispensers, the liquid is held in a flexible bag within the canister and so is separated from the propellant.

A nozzle is often fitted to the outlet valve by means of a valve stem to ensure the product is delivered in an appropriate form and direction for the application. Many aerosols have an atomising nozzle fitted to the outlet valve, the nozzle being configured to cause the liquid stream passing through the nozzle under pressure to break up or "atomise" into numerous droplets as it passes through an outlet orifice of the nozzle to form an atomised spray or mist. A large number of commercial products are presented to consumers in this form, including, for example, antiperspirant sprays, de-odorant sprays, perfumes, air fresheners, antiseptics, paints, insecticides, polish, hair care products, pharmaceuticals, water and lubricants.

The optimum size of the droplets required in the spray depends primarily on the particular product concerned and the application for which it is intended. For example, a pharmaceutical spray that contains a drug intended to be inhaled by a patient (e.g. an asthmatic patient) usually requires very small droplets, which can penetrate deep into the lungs. In contrast, a polish spray preferably comprises spray droplets with larger diameters to promote the impaction of the aerosol droplets on the surface that is to be polished and, particularly if the spray is toxic, to reduce the extent of inhalation.

The size of the aerosol droplets produced by conventional nozzle arrangements is dictated by a number of factors, including the dimensions of the outlet orifice and the pressure with which the fluid is forced through the nozzle. However, problems can arise if it is desired to produce a spray that comprises small droplets with a narrow droplet size distribution, particularly at low pressures. The use of low pressures for generating sprays is becoming increasingly desirable because it enables the quantity of propellant present in the spray to be reduced or alternative propellants which produce lower pressures, such as compressed air, to be used. The problem of providing a high quality spray at low pressures is further exacerbated if the fluid concerned has a high viscosity because it becomes harder to atomise the fluid into sufficiently small droplets.

A further problem with known pressurised aerosol dispensers fitted with conventional valve and nozzle arrangements is that the size of the aerosol droplets generated tends to increase during the lifetime of the aerosol dispenser, particularly towards the end of the dispenser's life as the pressure within the canister reduces as the contents become gradually depleted. This reduction in pressure causes an observable increase in the size of the aerosol droplets generated and thus, the quality of the spray produced is compromised.

The amount by which the pressure drops over the life of the dispenser varies depending on the type of propellant used. Where the propellant, such as butane, exists in the canister both as a liquid and a gas, the reduction in pressure over the life of the dispenser may be 20-30%. With this type of propellant, more gas comes out of solution as the product is used up and the pressure in the canister drops. By comparison, with propellants that are present mainly or exclusively as a compressed gas, the overall reduction in pressure may be 50% or more.

To assist in the break up of droplets and improve atomisation some known aerosol dispenser valves are provided with one or more fine holes in the housing of the valve through which the propellant gas can be bled into the liquid product as it is dispensed through the valve. These holes are known as a vapour phase tap (VPT).

A problem with the use of a VPT is that the propellant gas is used up more quickly, exacerbating the problems discussed above in regard to the loss of pressure in the canister over the life of the dispenser. This is a problem regardless of the propellant used but is a particular problem where the propellant is a compressed gas, such as air or nitrogen, where the loss of pressure may result in an unacceptable performance as the contents become depleted. For example, in a typical dispenser without a VPT and which uses compressed air as the propellant, the starting pressure will be around 10 bar reducing to around 4 bars. However, if a VPT is used, the pressure may fall to less than 2 bars, which is insufficient to atomise the liquid.

For the purposes of atomisation of the liquid product, it is preferable if the VPT produces a higher ratio of propellant gas to liquid when the pressure in the canister is lower than when the canister is full and the pressure is higher. This is because at the higher pressures, the relatively high rate of flow of the liquid through the nozzle is sufficient on its own to cause the required atomisation without the need to introduce propellant gas into the liquid stream through the VPT. However, with a conventional VPT, the opposite effect is seen as the ratio of propellant gas to liquid falls as the pressure in the canister falls. This can be explained by considering the flow through the VPT. The gas flows through the VPT because the liquid flowing through the housing is at a lower pressure than the gas on the outside of the housing and the rate at which the gas flows through the VPT is a function cross sectional area of the VPT and the pressure difference across it. Because the cross sectional area of the VPT is fixed, the volumetric flow rate through the VPT reduces as the pressure in the canister falls.

In order to ensure that sufficient gas is bled into the liquid to provide for proper atomisation of the liquid when the pressure in the canister has reduced towards the end of the life of the dispenser, the VPT openings have to be a certain minimum size. However, this means that excess propellant gas is bled into the liquid when the canister is full and the pressure is higher. It can be seen, therefore, that with a conventional VPT a considerable amount of the propellant gas bled through the VPT when the canister is relatively full is wasted, as it is not essential for ensuring proper atomisation of the liquid. This problem is further compounded because the propellant gas is compressible and hence for a given volumetric flow rate, a greater mass of gas will pass through the VPT when the canister is full and is at its highest pressure than when the canister is nearly empty and the pressure inside the canister has dropped.

Varying the manner in which the gas is delivered into the valve housing thorough a VPT has been found to make a significant difference to the droplet size and to the spray form of the aerosol. It has been found in particular that several small holes give better results than one large hole. However, there are difficulties in manufacturing small holes. Typically, the valve housing is injection moulded from polymeric materials and the VPT holes are produced using pins in the mould.

In order to produce smaller holes the size of the pins needs to be reduced but if very fine pins are used they have a tendency to break. A further problem with very small holes is that they can become blocked.

There is a need then to provide an improved aerosol dispenser that overcomes, or at least reduces, the problems of the prior art dispensers.

There is a particular need to provide an improved aerosol dispenser having a VPT, in which the overall amount of propellant gas bled into the liquid product through the VPT is reduced whilst ensuring adequate atomisation of the liquid over the useful life of the dispenser.

In accordance with the invention, there is provided an aerosol dispenser comprising a canister adapted to contain a liquid product to be dispensed and a propellant present in the canister at least partly as a gas, said dispenser having a valve for controlling the release of the liquid product from the canister and means for introducing a portion of the gaseous propellant into the liquid product as it is dispensed, characterised in that the dispenser further comprises a flow control means for varying the rate at which the propellant gas is introduced into the liquid product in dependence on the pressure of the contents in the canister.

Further optional features of the invention are set out in the dependent claims.

Several embodiments of the invention will now be described, by way of example only, with reference to the following drawings in which:

FIGS. 2 to 21B are various schematic views, some in cross-section, illustrating different embodiments of a flow control device forming part of a dispenser in accordance with the invention;

Figure 1A:
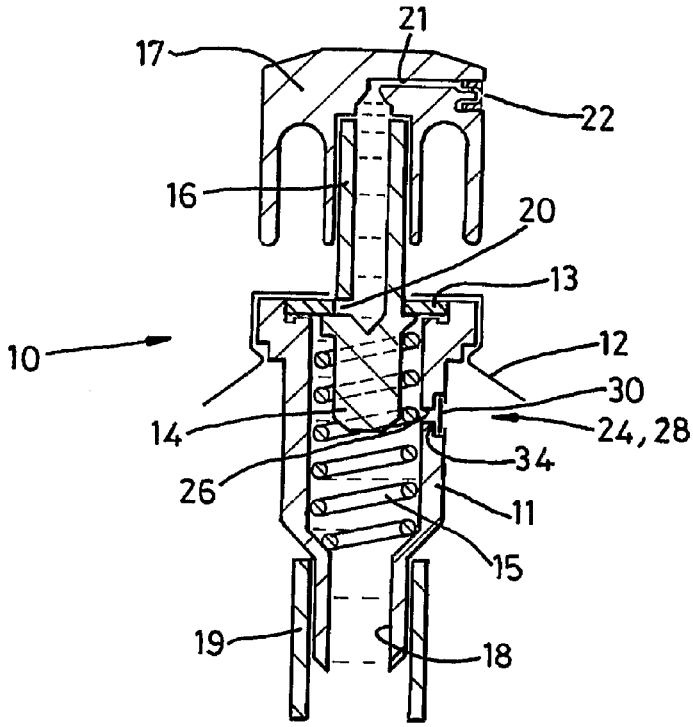
FIG. 1A is a cross-sectional view through a male aerosol valve arrangement forming part of a dispenser in accordance with the invention, showing the valve when closed.
Figure 1B:
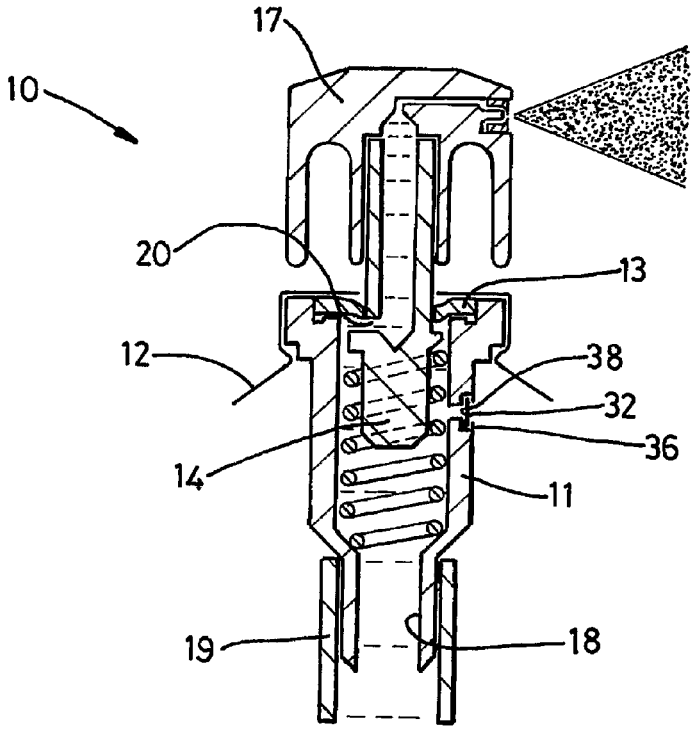
FIG. 1B is a view similar to that of FIG. 1A but showing the aerosol valve when open.

FIGS. 1A and 1B show a male type aerosol valve 10 forming part of a dispenser in accordance with the invention. The valve 10 has a hollow plastic housing 11 mounted in a metal cup 12 which forms part of an upper surface of an aerosol canister. As is well known in the art, the aerosol canister will typically contain a liquid product, which may be a liquor, to be dispensed and a propellant, at least part of which is present as a gas above the product. The propellant pressurizes the canister so that the product is dispensed when the valve is opened. Any suitable propellant may be used such as butane, compressed air, nitrogen or carbon dioxide, for example.

A sealing gasket 13 is located in a recess at the upper end of the housing. A valve member 14 is slidably positioned inside the housing and is biased upwardly by means of a spring 15. A valve stem 16 projects upwardly from the valve member and is received in an actuator/nozzle 17. A lower end of the housing provides an inlet 18 to the valve and also mounts a dip tube 19. The valve stem 16 is hollow and a hole 20 is provided at the base of the stem through which fluid can exit the valve housing and enter the stem when the valve is opened.

When the dispenser is not actuated, the valve member is biased by the spring to its upper position, as shown in FIG. 1A, so that the hole 20 is sealed by the gasket and the valve is closed. However, when downward pressure is applied to the actuator/nozzle 17, the valve member 14 is moved downwardly in the housing against the bias of the spring, as shown in FIG. 1B, so that hole 20 becomes exposed. The product, together with the propellant, passes through hole 20 into the stem from where it enters an outlet passage 21 in the actuator/nozzle before being dispensed in aerosol or spray form from an outlet orifice 22 of the actuator/nozzle.

To assist with the atomisation of the liquid, a VPT 24 is formed in a side wall of the housing 11 through which the gaseous propellant above the liquid product in the canister can be introduced or bled into the liquid product as it passes through the valve 10. The VPT 24 comprises a small hole or opening 26 through the side wall of the housing 11 through which the gaseous propellant can pass to enter the liquid product within the valve housing. The VPT 24 also has a flow control device 28 configured to control the rate at which the gas flows through the VPT 24 is response to changes in the pressure inside the canister.

The flow control device 28 comprises a flow control element 30, which is located in an enlarged recess or chamber 32 formed in an outer surface of the wall of the housing 11 about the VPT opening 26. In the present embodiment, the flow control element 30 is in the form of a disc shaped shuttle that moves freely within the recess 32, which is circular. When the valve 10 is open, the element 30 is pressed towards the inner end wall 34 of the recess by the pressure of the gas flowing through the recess 32 so that it restricts the flow of gas through the opening 26. The flow control element is held within the recess by means of an inwardly projecting lip 36 formed about an outer end of the recess, though any suitable means of retaining the element 30 can be used.

The flow control element 30 has a substantially flat inner face 38 which opposes a corresponding flat face of the inner or downstream end wall 34 of the recess in which the VPT opening 26 is formed. As shown in FIGS. 1A and 1B, the outer diameter of the of the flow control element 30 is greater than that of the VPT opening 26 so that it completely covers the opening and overlaps with at least part of the inner end wall 34. However, by appropriate design and selection of materials, it can be arranged that the flow control element 30 does not form a perfect seal with the inner end wall 34 such that the propellant gas can pass between the flow control element 30 and the end wall 34 and through the VPT opening 26 in to the valve housing.

The force with which the element 30 is pushed towards the end wall 34 is proportional to the pressure difference acting across the opening 26 (i.e. the difference in pressure between the gas on the outside of the housing and the liquid product flowing through the housing). When the dispenser is full and the pressure in the canister is at its highest, the pressure differential across the opening will be relatively high and the flow control element 30 is pressed towards the end wall 34 with a correspondingly high force forming a close partial seal with the face of the wall and offering a relatively high resistance to the flow of propellant through the VPT opening 26. As the dispenser empties and the pressure in the canister falls, the pressure differential across the VPT opening 26 when the valve is opened also falls. As a result, the force pushing the flow control element 30 towards the inner end wall 34 will be lower and the propellant will be able to pass between the flow control element 30 and the inner end wall 34 more easily. Thus the flow control device 28 offers a greater resistance to the flow of gas through the VPT opening when the pressure in the canister is relatively high than when the pressure in the canister is relatively low.

The flow control means 28 helps to reduce the overall loss of propellant gas through the VPT 24 by restricting the flow of gas when the pressure in the canister is relatively high and there is less need to bled gas into the liquid to ensure atomisation. However, the device 28 is configured to allow sufficient gas to flow through the VPT when the pressure in the canister has dropped to provide a ratio of gas to liquid sufficiently high as to ensure adequate atomisation of the liquid as it flows through the nozzle. As less gas is lost through the VPT, the overall pressure drop in the canister is also reduced and, by appropriate design, it can be arranged that there is sufficient pressure in the canister to achieve adequate atomisation of the liquid product over the whole useful life of the dispenser or that the useful life is increased.

In the present embodiment, the flow control means 28 is configured so that, over a given range of pressure variation in the canister, the rate of flow of gas through the VPT remains fairly constant or at least more so than would be the case without the flow control device 28. However, in practice it may be sufficient to merely to restrict the flow of gas through the VPT when the pressure in the canister is relatively high so as to reduce wastage of the propellant gas. In a further alternative, the flow control device 28 could be configured so that the flow rate of the gas through the VPT increases as the pressure in the canister falls. It will be appreciated that a flow control means can be configured in a number of ways whilst still achieving the objective of reducing the wastage of propellant gas through the VPT. For example, a flow control means could be configured so that the ratio of gas to liquid product dispensed remains generally constant or that the ratio of gas to liquid product increases as the pressure in the canister falls.

In one embodiment, the flow control element 30 and the inner face of the end wall 34 of the recess are made from rigid or a semi-rigid materials such as polypropylene or nylon plastic, metal or ceramic so that the two corresponding flat faces 38, 34 are not able to form a true seal even when they are pressed together by the pressure differential across the opening. However, for certain applications that are required to operate at lower pressure differentials, it may be appropriate to use softer materials as these can form a partial seal more easily.

To ensure that a complete seal is not formed between the flow control element 30 and the inner face of the end wall 34 of the recess, the corresponding surfaces of the inner end wall 34 of the recess and/or the face 38 of the flow control element 30 may be textured or other means may be provided to space the flow control element 30 from the inner end wall 34 by a very small amount. Alternatively, grooves may be formed in the surface of the inner end wall 34 of the recess and/or the face 38 of the flow control element along which the fluid can pass to reach the VPT opening 26.

In certain embodiments, at least part of the face 38 of the flow control element 34 will contact the wall 34 whilst fluid is flowing through the opening 26. However, in other embodiments, particularly where the faces of the element 38 and the wall 34 are smooth, the fluid flowing between the faces may force them apart by a very small amount. In most cases, the gap between the faces 38, 34 in use will be no more than 0.01 mm but in certain circumstances the gap may be up to a maximum 0.3 mm or even up to a maximum of 0.6 mm. It should be appreciated that the spacing between the faces in use is dependant on the pressure differential between the gas outside the valve housing and the liquid inside. Where the pressure differential is high, as will be the case when the canister is full or nearly full, the gap between the faces will be small so that the cross sectional area through which the fluid can flow is correspondingly small. As the contents of the canister are used up, the pressure differential will fall and the gap between the faces 38, 34 will increase so that the cross sectional area through which the fluid can flow to pass through the opening 26 also increases. Since the rate of flow of the fluid through the VPT is dependent on the pressure differential and the minimum cross sectional area through which it must pass, it can be arranged that a decrease in the pressure differential is at least partially offset by an increase in the cross sectional area of the gap between the faces to maintain a generally constant flow rate.

The design of the flow control device 28 can be varied to suit the particular requirements of the application. The key is to create an interaction between the inner end wall 34, or in some cases the side wall, of the recess and the flow control element 30 that allows the propellant gas to pass through the VPT opening 26 in a controlled way. Hence, the seal between the flow control element 30 and the inner end wall 34 of the recess is partial and never complete in the pressure range required but increases in effectiveness with the pressure differential across the opening (which in turn is usually proportional to the pressure in the canister) in such a way that the rate of flow of the propellant through the VPT opening 26 remains generally constant within acceptable tolerances.

Figure 22A:
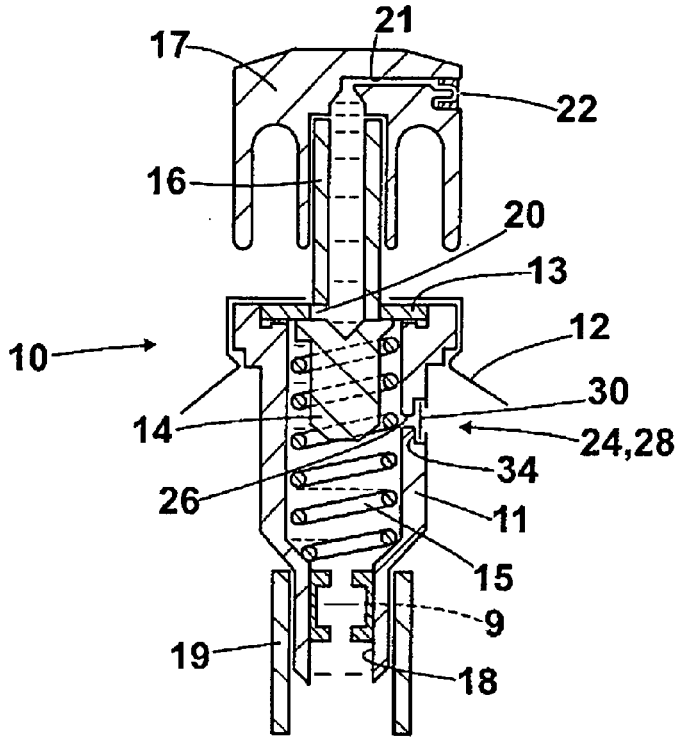
FIG. 22A is the cross-sectional view through a male aerosol valve arrangement forming part of a dispenser showing the valve when closed similar to FIG. 1A but showing a further flow control device at the inlet to the valve.
Figure 22B:
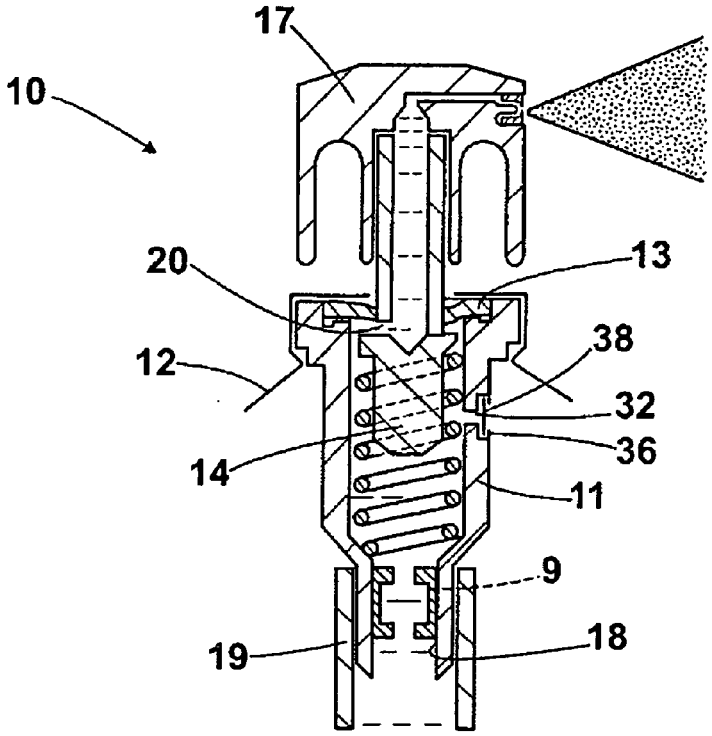
FIG. 22B is a view similar to that of FIG. 22A but showing the aerosol valve when open.

Referring to FIG. 22A and FIG. 22B, a further flow control device 9 can also be provided at the inlet to the valve 10 to control the flow of the liquid product through the valve 10. Since the rate of flow of the gas through the VPT 26 is dependent on the pressure differential between the liquid inside the housing and the gas outside. By controlling the rate at which the liquid flows through the valve 10, the pressure differential can also be controlled which will affect the rate of flow of the gas through the VPT. Controlling the flow rates of both the liquid and the gas allows greater control over the rate at which the gas is bled through the VPT 26.

The further flow control device 9 may be configured to maintain a substantially constant flow rate of the liquid product so that the ratio of propellant gas to liquid in the product dispensed also remains substantially constant. Alternatively, the further flow control device may be configured to allow an increased flow of liquid product when the pressure in the canister is higher than when it is lower so that the ratio of gas propellant to liquid in the product dispensed increases as the pressure in the canister drops. The further control device 9 may be provided at the inlet to the valve prior to the liquid mixing with the gas or at the outlet. The further flow device may be of any suitable type and may, for example, be similar to the flow device 28 described above in relation to FIGS. 1A and 1B or any of the variations described below.

The rate at which the propellant gas is bled into the liquid as it is dispensed may alternatively be controlled by using a flow control means to control the rate of flow of the combined liquid and gas ether in the valve itself, or downstream from the valve in the valve stem or the nozzle or between the valve and the stem or between the stem and the nozzle, for example.

The design of the flow control device 28 can be varied from that shown in FIGS. 1A and 1B, in order to produce different flow effects and/or to adapt the device for use over different pressure ranges and/or for use with different propellants and to cater for the desired flow range and the properties of the liquid product. In practice, it is expected that the configuration of the flow control device 28 will be adapted to meet the specific needs of the particular application, taking into consideration all the relevant factors including, for example, the desired pressure range, the desired flow rate and the properties of the liquid product and the propellant gas.

FIGS. 2 to 21B are schematic drawings that illustrate a number of possible configurations that can be used in a flow control device 28 of a dispenser in accordance with the invention. These drawings show only the flow control device itself, or a part thereof. It will be appreciated that the flow control devices shown will be incorporated into the valve 10 itself in a manner similar to that shown in FIGS. 1A and 1B.

Figure 2:
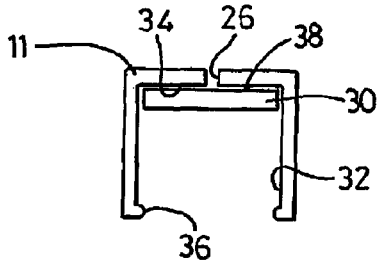
Figure 3:
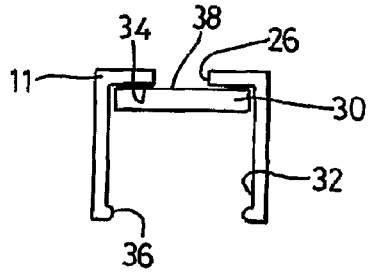
Figure 4:
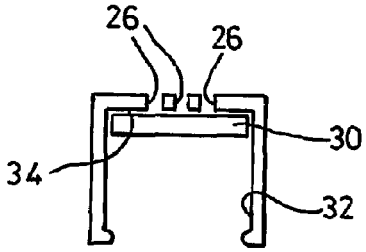

As the flow control device 28 is adapted to deliver a fairly constant flow across a range of pressures, it is necessary to be able to adapt the design to be able to deliver different flow rates across that range of pressures. Hence, if one configuration delivers a flow rate of 2 l/m for pressures of 2-10 bars, it will be necessary to change the configuration in order to deliver a flow rate of say 3 l/m over the same pressure range. The simplest way to achieve this is to vary the size of the VPT opening 26 such that the larger the opening, the greater the flow rate. Alternatively, it is possible to provide multiple VPT openings 26 in the inner end wall 34 to provide a greater flow rate. FIGS. 2 and 3 illustrate flow control apparatus in which the size of the VPT opening 26 is varied whilst FIG. 4 illustrates the use of multiple openings.

Other factors that may influence the flow rate are the surface finish of the inner end wall 34 of the recess 32 and/or the face 38 of the flow control element and the materials from which the inner end wall 34 and/or flow control element are manufactured. Thus, a smooth surface finish will tend to reduce the flow rate compared with a rough or textured surface finish. Also, as discussed above, the use of harder materials will tend to increase the leakage between the flow control element 30 and the inner end wall 34 and so will lead to a greater flow rate than would be achieved if softer materials are used.

Figure 5:
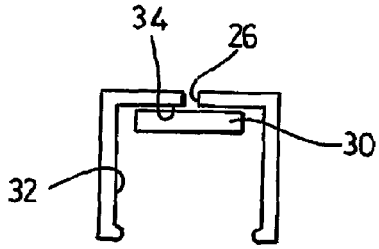

Another way of controlling the flow rate through the device 28 is to alter the overlap or contact area between the flow control element 30 and the inner end wall 34 of the recess. The required overlap to achieve a desired flow rate depends on the size of the opening or openings 26, the materials of the flow control element 30 and the inner end wall 34, the surface finish of the corresponding surfaces of flow control element and the inner end wall 34, the pressure range involved and the properties of the propellant gas. However, generally speaking, different overlaps permit different levels of leakage and these determine the flow rates. At higher pressures, over say 4 bar, the overlap can be reduced as the flow tends to be stable whereas at lower pressures the overlapping area may need to be larger. FIG. 5 illustrates a flow control apparatus having a reduced overlap between the flow control element 30 and the inner end wall 34 compared with that of the flow control apparatus shown in FIG. 2.

Although not shown in the accompanying drawings, an alternative method of reducing the overlap, whilst ensuring the shuffle remains stable in the recess, is to reduce the outer diameter of shuttle and provide a number of vanes which project outwardly to contact the side wall of the recess. A further alternative, also not shown, would be to use a square or triangular shaped shuttle in which the comers of the shuttle contact the side wall of the recess.

Figure 6:
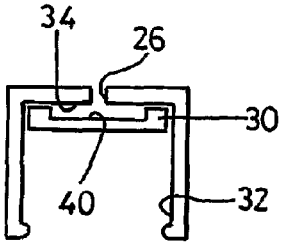

A further design option as illustrated in FIG. 6, is to provide a circular recess 40 in the face 38 of the flow control element 30 that faces the inner end wall 34 of the recess. This reduces the contact area or overlap between the flow control element and the wall which tends to increase the flow rate. Furthermore, the recess 40 can be used as a swirl chamber to impart rotation into the propellant gas causing it to form a spray or jet as it passes through the opening 26. To aid this effect, the gas may be caused to spin around the recess in which the flow control element is located so that when it enters the recess 40 it is already spinning. This could be achieved by using a tangential input into the recess 32 from the outside of the valve or by using a known swirl device upstream from the flow control element. Alternatively, or in addition, curved veins (not shown) could be put inside and around part of the circular recess 40 or VPT opening 26 to cause the propellant gas to spin and create a conical spray or jet into the liquid in the valve. If there is more than one VPT opening 26 in the wall, several recesses 40 could be provided, each acting as a swirl chamber for a respective one of the openings. The recess 40 can be of any suitable shape.

Figure 7:
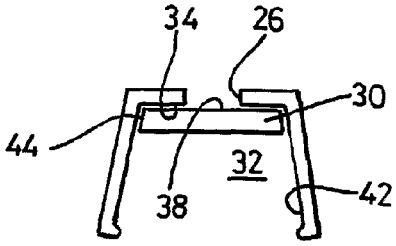

FIG. 7 illustrates a flow control device in which the recess 32 and the flow control element 30 are conical or frusto-conical, tapering inwardly towards the inner end wall 34. With this arrangement, a spiral formation (not shown) can be applied to the side wall 42 of the recess or the side 44 of the flow control element 30 to cause the gas to spin and create a conical spray or jet through the VPT opening 26. In an alternative embodiment (not shown) the inner end wall 34 of the recess 32 may be omitted so that the fluid will pass between the conical side 44 of the flow control element 30 and the side wall 42 the recess 32. In such an embodiment, the side wall of the element 30 and the side wall 42 of the passage comprise the corresponding faces between which the gas passes to reach the VPT opening. The flow control element 30 used in this embodiment can be of any suitable shape such as any of those shown in the accompanying drawings. A swirl arrangement may also be used to cause the propellant gas to rotate either before it reaches the flow control element, after the flow control element or around the flow control element. In certain applications, it may be advantageous for the partial seal between the flow control element and the conical side wall 42 of the recess to be formed along a thin line. This could be achieved, for example, by not tapering the side 44 of the flow control element 30.

Figure 8:
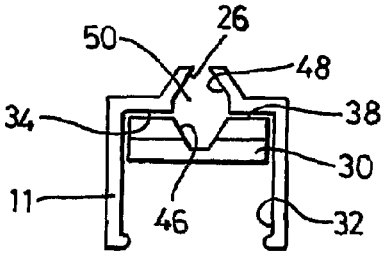

FIG. 8 shows an arrangement in which a conical recess 46 is formed in the face 38 of the flow control element 30 and a corresponding conical recess 48 is formed in the inner end wall 34 of the recess about the VPT opening 26. This arrangement creates an expansion chamber 50 into which the propellant gas passes from between the flow control element 30 and the inner end wall 34 of the recess. Where the wall 34 has multiple VPT openings 26, the face 38 of the flow control element and/or the wall 34 can have a corresponding number of recesses to provide an expansion chamber 50 for each opening. The openings 26 will usually be located centrally of their respective chambers. The expansion chamber(s) 50 can be of any suitable shape.

Figure 9:
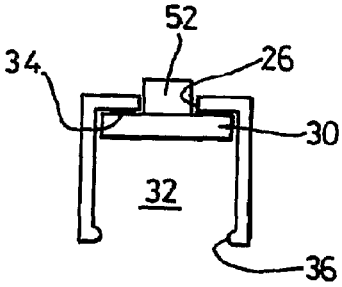

As shown in FIG. 9, a post 52 may project from the flow control element 30 into the VPT opening 26. If the gap between the post 52 and the side of the opening is small, the gas will form a spray or jet in the liquid as it passes through the gap. A series of fine grooves could be provided around the inside of the VPT opening 26 or on the surface of the post 52 that effectively create a number of semi-circular openings between the post and the wall defining the opening 26 which would operate as multiple fine spray/jet orifices into the interior of the valve housing 11. The post 52 could be flush with the VPT opening 26 and both the outer circumference of the post 52 and the opening 26 could be conical.

Whilst the face 38 of the flow control element 30 and the inner end wall 34 of the recess may be flat, they can be shaped in certain ways that ensure only a partial seal is formed and to vary the flow rate. FIG. 10 illustrates a flow control device 28 in which the face 38 of the flow control element 30 is convex but other shapes can be used. Varying the shape of the flow control element 30 and/or the end wall 34 of the recess can be used to direct the gas into the valve housing in different ways.

FIG. 11 illustrates a flow control device in which the flow control element 30 is in the form of a flap connected to the walls of the recess along one edge. As shown in FIG. 11, the flap would normally adopt a position spaced from the end wall 34 of the recess by a small amount when it is not subjected to pressure within the canister but is configured to be pressed into contact, or close proximity, with the wall by the pressure in the canister in use. However, the flap could be arranged to contact or lie close to the wall 34 at all times but be configured so that the effectiveness of the seal formed between the flap and wall increases as the pressure of the fluid acting on the flap rises to control the rate of flow.

As discussed above, the surface finish of the flow control element 30 and/or the wall 34 can be modified to vary the flow rate and other flow characteristics. For example, a series of fine rods could project from the wall 34 or from the face 38 of the flow control element 30 to ensure a minimum spacing is maintained and which could act as a filter. Alternatively, grooves could be formed in the wall 34 and/or in the face 38 of the flow control element. The grooves would ensure that there was at least a minimum flow of gas and could be arranged to impart particular flow characteristics to the gas causing it to spry into the liquid through the VPT opening 26.

FIGS. 12 to 14 illustrate some examples of groove arrangements that might be used. These drawings show the face 38 of the flow control element 30 with the inner circle 54 being indicative of the position of the VPT opening 26 in the inner end wall 34 of the recess. It should be understood that the grooves could be formed in the wall 34 of the recess rather than in the end face 38 of the flow control element 30 or in both if desired.

In FIG. 12, a circular groove 56 having a diameter larger than that of the VPT opening 26 has a number of radial spoke like grooves 58 leading towards the centre of the flow control element 30 and the VPT opening 26. With this arrangement, the gas would collect in the circular groove 56 and then travel along the radial grooves 58 towards their inner ends where it would enter the VPT opening 26 as a series of fine sprays or jets. If the end face 38 of the flow control element and the wall 34 are conical, the gas would spray or jet outwards into the valve housing and could be directed so that the various sprays/jets hit each other or miss each other as required.

In FIG. 13, an outer circular groove 56 is connected to a central recess 60 by two straight radial grooves 62, 64 which may be of different sizes. The radial grooves 62, 64 are arranged to enter the central recess non-tangentially on different sides of the VPT opening 26 so as to cause the gas to rotate within the central recess 60 so that it is spinning as it enters the VPT opening 26.

In FIG. 14, an outer circular groove 56 is connected to a central recess 60 by two curved radial grooves 66, 68 which direct the gas into the central recess tangentially in the manner of a swirl chamber to case the gas to spin in the recess from which it passes through the VPT opening 26.

Any suitable groove pattern can be applied to the surface of the flow control element 30 and/or the wall 34. Where the grooves are formed in the wall, the flow control element 30 would normally cover all the grooves so that the fluid had to pass between the element 30 and the wall 34 to reach the grooves.

Figure 15A:
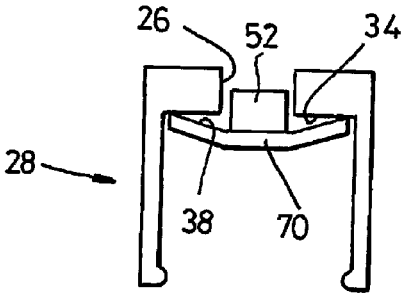
Figure 15B:
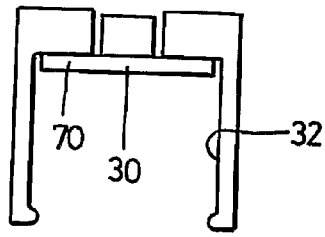

The embodiment shown in FIGS. 15A and 15B illustrate how the control element 30 can be modified to form an integral spring to form a self cleaning VPT. A main body portion 70 of the control element has a dish shape with a concave face 38 which opposes the inner face of the wall 34 with the opening 26. As shown in FIG. 15B, the main body portion can be compressed against the wall 34 by the pressure of the gas flowing through the recess 32 so as to act as a flow control device in the manner previously described. When the valve 10 is closed and the flow of gas through the VPT 26 stops, the main body portion 70 will resume its dished shape, as shown in FIG. 15A, so that any foreign matter trapped between the flow control element 30 and the wall 34 is released. The flow control element 30 may have a central post 52 which projects into the opening 26 as shown or this may be omitted. The flow control element 30, or at least part of the dish shaped main body portion 70 may be made of a flexible, resilient material so that the spring effect is retained for longer than would be the case with a generally rigid material.

Figure 16A:
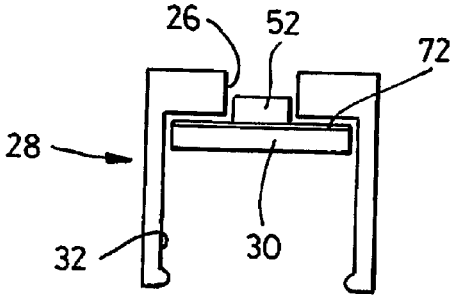
Figure 16B:
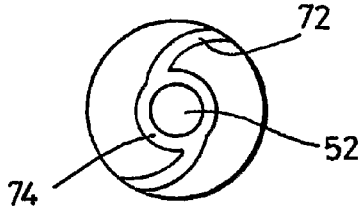

In the embodiment shown in FIGS. 16A and 16B, the flow control element 30 has a central post 52 which extends into the VPT opening 26 in the wall 34 but is also provided with a swirl inducing formation 72 on the face 38 of the element which abuts the wall 34. As shown in FIG. 16B, which is an end elevation of the element 30, the swirl formation 72 includes two curved grooves which direct the gas into a circular recess 74 surrounding the post 52 so that the gas spins about the post forming a cone as it passes through the VPT 26. The height of the post 52 in the opening 26 dictates the shape of the cone. Unlike a conventional swirl arrangement, the control element 30 is able to move relative to the wall 34 to control the rate of flow of fluid through the VPT opening 26. Causing the gas to swirl prior to entering the valve housing can help to promote mixing of the gas and the liquid in the housing, which in turn helps to improve the quality of the final spray produced at the nozzle outlet.

Figure 17A:
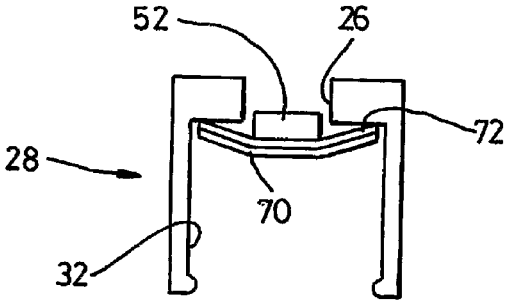
Figure 17B:
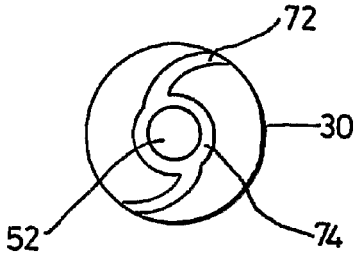
Figure 18:
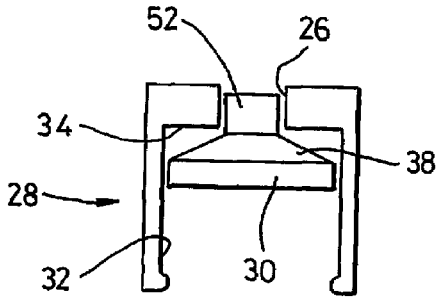
Figure 19:
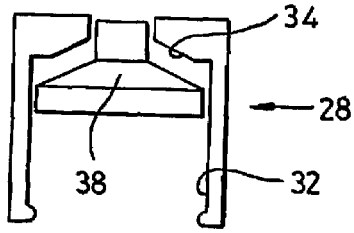

It should be appreciated that any of the various features shown in the embodiments described herein can be combined in any suitable way to produce a desired flow control arrangement. For example, FIGS. 17A and 17B illustrate an embodiment which combines the features of the dished control element 30 as described above in relation to FIGS. 15A and 15B and the swirl inducing grooves 72, similar to that described above in relation to FIGS. 16A and 16B, formed on the face 38 of the element which abuts the wall 42.

Figure 20A:
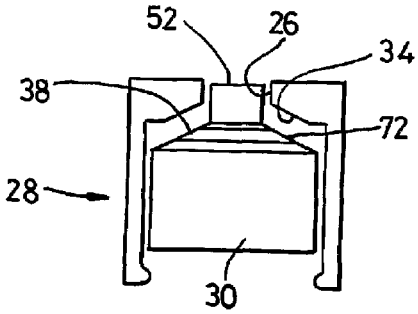
Figure 20B:
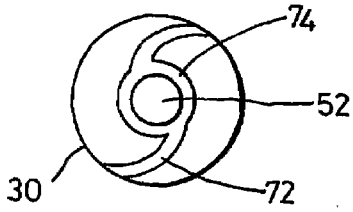

The face 38 of the element 30 need not be flat, FIGS. 18, 19, 20A and 20B illustrate embodiments in which the control element 30 has a tapered face 38 for cooperation with the end wall 34 of the recess. In the embodiment shown in FIG. 18, the end wall 34 of the recess 32 is flat so that the tapered wall 38 of the control element makes a partial point or line seal with the wall 34 at the edge of the opening 26. In the FIG. 19 embodiment, the wall 34 has a corresponding tapered wall surface 76 about the opening 26 which mates with the tapered face 38 of the flow control element. FIGS. 20A and 20B illustrate an embodiment similar to that of FIG. 19 except that a swirl arrangement 72, similar to that described above in relation to FIGS. 16A and 16B, is formed on the tapered surface 38 of the flow control element. The swirl inducing grooves 72 can best be seen in FIG. 20B, which is an end elevation from above of the flow control element 30.

Figure 21A:
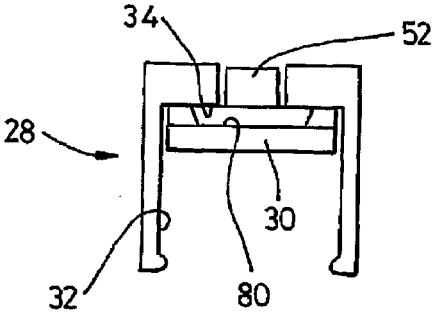
Figure 21B:
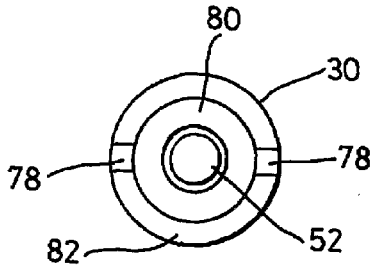

FIGS. 21A and 21B illustrate an embodiment in which the flow control element has grooves 78 formed in the surface 38 which contacts the wall 34. FIG. 21B is an end elevation of the flow control element 30 which has a central recess 80 surrounded by an annular portion 82 which abuts the wall 34. The grooves 78 extend across the annular portion on two sides so that the fluid can pass through the grooves into the central recess and pass out though the VPT opening 26. The control element 30 also has a post 52 which projects from the centre of the recess into the opening 26 in the wall 34 but this could be omitted. The control element 30 may be made of a flexible material so that when the element 30 is pressed into contact with the wall, the grooves 78 are partially collapsed to resist the flow. The greater the force acting to push the element 30 into contact with the wall 34, the more the grooves are collapsed and greater the resistance to the flow of gas. The arrangement can be used to control the flow rate of gas through the opening 26 since the minimum cross sectional area of the grooves through which the gas flows is varied as a function of the force biasing the element in to the end wall 34, which is itself a function of the pressure differential acting across the opening 26. In an alternative arrangement, the grooves could be formed on the inner face of the wall 34 so that the flexible material of the flow control element is pushed into the grooves when the element is compressed against the end wall 34 to partially fill the grooves and so regulate the flow through the opening. The central recess could be reduced in size or omitted altogether so that the grooves 78 are formed in a flat face 38 of the flow control element so long as they are in fluid connection with the opening 26 when in use.

The recess 32 in which the flow control element 30 is located can be of any suitable shape and especially could be any of the shapes of the chambers disclosed in the applicant's co-pending International patent application published as WO 2005/005055, the entire content of which is hereby incorporated by reference. Thus the shape of any of the recesses in any of the embodiments described above can be modified in accordance with the principles discussed in WO 2005/005055. Similarly, where a recess 40 or expansion chamber 50 is provided between the flow control element 30 and the wall 34, the recess or chamber can also be of any suitable shape including those disclosed in WO 2005/005055.

A number of fine VPTs enable a better mixing of the gas in the liquor and ultimately a finer spray is produce but such fine holes are difficult to produce. However, where the VPT 24 includes a flow control device 28 such as those described herein the VPT hole or opening 26 can be much larger than with a conventional VPT making it easier to manufacture.

It is also possible to design the flow control device 28 to allow only a gas to pass through whilst preventing, or at least minimising, the passage of a fluid through the device. This can be achieved by configuring the apparatus so that the flow control element 30 creates a close partial seal with the wall 34 through which only a gas can pass. In this arrangement, the flow control element 30 and/or the wall 34 may be made of, or covered by, a flexible material like rubber that forms good seal. In this arrangement, the wall 34 against which the flow control element 30 abuts may be in the form of a fine mesh that could become the equivalent of a membrane.

As can be seen from some of the embodiments described above, in addition to controlling the rate of flow of the gas, the flow control device 28 can be designed to cause the gas to spin and/or jet into the housing. This is advantageous as it generates increased turbulence inside the housing, which helps to promote mixing between the gas and liquid and improves the final spray quality.

A further advantage of the various embodiments described herein is that the flow control device 28 is self cleaning. The element 30 can be moved away from the end wall 34 and the opening 26 when the valve is closed and the pressure inside and outside the housing is equalised. This enables any small particles trapped between the element 30 and the end wall to fall clear of the VPT to prevent clogging. The ability to make the openings 26 in the present embodiments larger than standard VPT openings use of larger VPT holes can also be utilized when filling the canisters with gas as the gas can be injected under pressure through the valve 11 and the VPT opening 26, moving the flow control element 30 away from the end wall 34.

In a further variation, the outer end of the flow control element 30 which faces away from the end wall 34 of the recess can be adapted to form a filter to prevent debris from entering the valve 11 through the VPT opening 26. Thus the outer end could have a conical or fan like section with a number of fine slits or holes through which the gas can pass but which are small enough to trap most foreign particles. The conical or fan like section may extend outwardly into contact with the side wall of the recess 32.

The flow control element 30 may be manufactured from a combination of materials to provide the required properties. For example, the element may be manufactured from two or more different materials using a bi-injection moulding technique. Hence, the flow control element could be manufactured to comprise a rigid core with a flexible outer portion for contacting the wall to form a seal. Furthermore, two or more flow control elements could be used in series in the same recess so that they push against each other or with one going inside a recess or opening formed in or through another element 30.

It will be appreciated that the invention is not necessarily limited to dispensers comprising a flow control device 28 of the types described in the present application but can be implemented using any suitable flow control device to control the flow rate at which the propellant is introduced into the liquid as it is dispensed. It should also be appreciated that the flow control device need not be provided in a side wall of the housing but could be provided anywhere in the housing such as in a base region surrounding the inlet. Indeed the flow control device can be provided anywhere within the valve including in the valve stem or on an auxiliary part to the valve. For example, if the dispenser is fitted with a tilt device mounted to or integrated with the dip tube to enable the dispenser to function more effectively when it is tilted or inverted, the flow control device may be provided in the tilt device. For a more detailed description of various embodiments of tilt device, the reader should refer to the applicant's International patent application WO 2004/022451, the content of which is hereby incorporated in its entirety by reference.

In addition, the invention is not limited to use with dispensers having the type of valve 10 described herein but can be applied to aerosol dispensers having any suitable form of valve. For example, the valve could be of the female type or of the split valve type in which the propellant gas and the liquid remain separated in the valve and mix either in the nozzle or in the valve stem. In this latter case, the flow control device could be located in the stem, between the stem and the nozzle, or in the nozzle itself. The invention can also be applied to aerosol dispensers in which the propellant is separated from the liquid product in the canister by a flexible bag. For example in certain dispensers the liquid product is contained in an elasticised or stretchable bag which expands when it is filled to compress air between itself and the outer walls of the canister. When the dispenser valve is opened, the compressed air acts as a propellant, squeezing the bag and forcing the contents through the valve under pressure.

Whereas the invention has been described in relation to what is presently considered to be the most practical and preferred embodiments, it is to be understood that the invention is not limited to the disclosed arrangements but rather is intended to cover various modifications and equivalent constructions included within the spirit and scope of the invention. It should be noted that a valve for an aerosol dispenser comprising a VPT and a flow control means for controlling the rate of flow of a propellant gas through the VPT may also be claimed.

Where the terms "comprise", "comprises", "comprised" or "comprising" are used in this specification, they are to be interpreted as specifying the presence of the stated features, integers, steps or components referred to, but not to preclude the presence or addition of one or more other feature, integer, step, component or group thereof.

The invention claimed is:

1. An aerosol dispenser comprising a canister adapted to contain a liquid product to be dispensed and a propellant present in the canister at least partly as a gas, said dispenser having a valve for controlling the release of the liquid product from the canister and means for introducing a portion of the gaseous propellant into the liquid product as it is dispensed, the dispenser further comprising a flow control means for varying the rate at which the propellant gas is introduced into the liquid product in dependence on the pressure of the contents in the canister, characterised in that the flow control means is configured such that the ratio of propellant gas to liquid product dispensed is increased as the pressure in the dispenser decreases over the useful life of the dispenser.

2. An aerosol dispenser as claimed in claim 1, in which the flow control means is configured to maintain the rate of flow of the gaseous propellant into the liquid as it is dispensed generally constant over the useful life of the dispenser.

3. An aerosol dispenser as claimed in claim 1, in which the flow control means is configured such that the rate of flow of the gaseous propellant into the liquid as it is dispensed increases as the pressure in the canister decreases over the useful life of the canister.

4. An aerosol dispenser as claimed in claim 1, in which the flow control means is configured to reduce the rate of flow of the propellant gas in to the liquid product when the dispenser is substantially full when compared with the rate of flow of an equivalent conventional dispenser having no such flow control means.

5. An aerosol dispenser as claimed in claim 1, in which the flow control means is provided in the valve.

6. An aerosol dispenser as claimed in claim 1, in which the flow control means is provided in the flow path of the gas upstream of the point at which the propellant gas mixes with the liquid product.

7. An aerosol dispenser as claimed in claim 6, in which the propellant gas is introduced into the liquid product within a housing of the valve, such that the combined propellant gas and liquid product flow through the valve along a common flow path.

8. An aerosol dispenser as claimed in claim 6, in which the flow control means further comprises means for controlling the rate of flow of the liquid product as it is dispensed, the further flow control means being provided in the flow path of the liquid product upstream of the point at which the liquid mixes with the propellant gas.

9. An aerosol dispenser as claimed in claim 8, in which the further flow control is configured to reduce the rate of flow of the liquid through the valve as the pressure of the contents of the canister falls.

10. An aerosol dispenser as claimed in claim 1, in which the flow control means is self-cleaning.

11. An aerosol dispenser as claimed in claim 1, in which the flow control means also functions as a filter.

12. An aerosol dispenser as claimed in claim 1, in which the dispenser further comprises an atomising nozzle configured such that the product is dispensed through an outlet of the nozzle in the form of an atomised spray or aerosol.

13. An aerosol dispenser as claimed in claim 1, in which the propellant gas is present in the canister mainly or exclusively as a compressed gas.

14. An aerosol dispenser as claimed in claim 13, in which the propellant gas is selected from a group consisting of compressed air, compressed nitrogen, and compressed carbon dioxide.

15. An aerosol dispenser comprising a canister adapted to contain a liquid product to be dispensed and a propellant present in the canister at least partly as a gas, said dispenser having a valve for controlling the release of the liquid product from the canister and means for introducing a portion of the gaseous propellant into the liquid product as it is dispensed, characterised in that the dispenser further comprises a first flow control device for varying the rate at which the propellant gas is introduced into the liquid product in dependence on the pressure of the contents in the canister and a separate second flow control device for varying the rate at which the liquid flows through the valve in dependence on the pressure of the contents in the canister, the first and second flow control devices being configured such that the ratio of propellant gas to liquid product dispensed is increased as the pressure in the dispenser decreases over the useful life of the dispenser.

16. An aerosol dispenser as claimed in claim 15, in which the propellant gas is introduced into the liquid product within a housing of the valve, such that the combined propellant gas and liquid product flow through the valve along a common flow path.

17. An aerosol dispenser as claimed in claim 15, in which the second flow control device is configured to reduce the rate of flow of the liquid through the valve as the pressure in the canister drops.

18. An aerosol dispenser as claimed in claim 15, in which the propellant is present mainly or exclusively as a compressed gas.

19. An aerosol dispenser as claimed in claim 18, in which the propellant is selected from a group consisting of compressed air, compressed nitrogen, and compressed carbon dioxide.

20. An aerosol dispenser comprising a canister adapted to contain a liquid product to be dispensed and a propellant present in the canister at least partly as a gas, said dispenser having a valve for controlling the release of the liquid product from the canister and means for introducing a portion of the propellant gas into the liquid product as it is dispensed, the dispenser being configured so that the portion of the propellant gas is introduced into the liquid product within the valve so that the combined liquid and propellant gas flow through the valve along a common flow path, characterised in that the dispenser further comprises a flow control means for varying the rate at which the propellant gas is introduced into the liquid product in dependence on the pressure of the contents in the canister, the flow control means being configured such that the ratio of propellant gas to liquid product dispensed is increased as the pressure in the dispenser decreases over the useful life of the dispenser.

21. An aerosol dispenser as claimed in claim 20, in which the flow control means comprises a first flow control device for varying the rate at which the propellant gas is introduced into the liquid product in dependence on the pressure of the contents in the canister, the first flow control device being located in the flow path of the gas upstream of the point at which the propellant gas is introduced into the liquid product.

22. An aerosol dispenser as claimed in claim 21, in which the flow control means further comprises a separate second flow control device for varying the rate at which the liquid flows through the valve.

23. An aerosol dispenser as claimed in claim 22, in which the second flow control device is configured to reduce the rate of flow of liquid through the valve as the pressure in the canister drops.

24. An aerosol dispenser as claimed in claim 22, in which the second flow device is located in the flow path of the liquid upstream of the point at which the propellant gas is introduced into the liquid product.

25. An aerosol dispenser as claimed in claim 20, in which the valve comprises a valve housing and a movable valve member at least partially located in the housing for controlling the flow of liquid through the valve, the dispenser being configured such that the propellant gas is mixed with the liquid product within the valve housing.

26. An aerosol dispenser as claimed in claim 20, in which the propellant gas is present in the canister mainly or exclusively as a compressed gas.

27. An aerosol dispenser as claimed in claim 26, in which the propellant gas is selected from a group consisting of compressed air, compressed nitrogen, and compressed carbon dioxide.

* * * * *